US006212688B1

(12) United States Patent
Leslie

(10) Patent No.: US 6,212,688 B1
(45) Date of Patent: Apr. 10, 2001

(54) FIREFIGHTER'S GLOVE HOLDER

(76) Inventor: Henry E. Leslie, 319 Walton Ave., San Antonio, TX (US) 78225

( * ) Notice: Subject to any disclaimer, the term of this patent is extended or adjusted under 35 U.S.C. 154(b) by 0 days.

(21) Appl. No.: 09/238,124

(22) Filed: Jan. 27, 1999

(51) Int. Cl.[7] ..... A41D 19/00
(52) U.S. Cl. ..... 2/161.6; 2/160
(58) Field of Search ..... 2/159, 160, 161.6; 24/3.1, 15, 3.2, 3.11, 3.12, 904; 224/575, 576, 581, 914, 933

(56) References Cited

PUBLICATIONS

Chief Supply, Catalog 111, 3 pgs.

*Primary Examiner*—John J. Calvert
*Assistant Examiner*—Shirra L. Jenkins
(74) *Attorney, Agent, or Firm*—Jackson Walker LLP

(57) ABSTRACT

A glove holder to attach firefighter's glove to their uniform to help prevent their loss, and to provide for easy access of the gloves in case of emergency.

9 Claims, 5 Drawing Sheets

FIREFIGHTER'S GLOVE HOLDER

BACKGROUND OF THE INVENTION

1. Field of the Invention

A glove holder, more specifically, a glove holder for attaching to protective outer clothing of a firefighter's uniform.

2. Background Information

Firefighter's need good gloves for protection. The gloves should be readily available with the rest of their uniform, such as boots, coat, and helmet, for fast access in case of an emergency. Gloves are more easily lost or misplaced than the other parts of the firefighter's uniform. Therefore, it would be advantageous to provide a device that would secure the gloves when not in use to another part of the firefighter's uniform, such as the outer surface of the firefighter's protective coat. That way, grabbing the coat would mean the gloves are attached to the outside of the coat and in plain sight. If one or both gloves was missing, one would know right away.

A suitable glove holder would be constructed from National Fire Protection Agency (NFPA)-approved material such as: NOMEX®, KEVLAR®, leather, PBI, other suitable material, or combinations of the same. Further, it would be adjustable to hold large, medium or small size gloves securely to the outer surface of an article of the firefighter's uniform, such as the firefighter's protective coat.

Devices heretofore have not been available which combine a glove holder attachable to the outer surface of a firefighter's protective garment made from fireproof material, which size is adjustable to secure gloves of various sizes

SUMMARY OF THE INVENTION

Applicant's invention includes a strap, typically made from a fireproof material, such as: NOMEX®, KEVLAR®, leather, PBI, or combinations of the same. The strap has two ends an a body between the two ends. At the two ends are means to adjustably attach one end to the other to form the strap into an enclosure. The size of the enclosure is adjustable so the two ends may be pulled tightly to form a narrow enclosure with the gloves tightly held therein. The two ends, in one preferred embodiment, may be detached completely, one from the other, when not in use. In a second embodiment, Applicant's two ends are permanently attached and the body of the strap is an elastic material, such as bungee cord, covered with a fireproof fabric, such as: NOMEX®, KEVLAR®, leather, PBI, or combinations of the same.

Means to adjustably and releasably fasten the two removed ends one to another in the first preferred embodiment include: drawstring clasp of FIGS. 1, pull-the-dot snap fasteners of FIGS. 2, the elastic material of FIGS. 3, the VELCRO® of FIGS. 4, the tourniquet buckle of FIGS. 5, and the D-rings of FIGS. 6.

Applicant's glove holder also includes, attached to the body of the strap means to either permanently fasten the strap to the outer garment or to removably fasten strap to the outer garment. To permanently attach the strap to the outer garment, a portion of the strap may be sewn, with fireproof thread, to the outer surface of the firefighter's protective garment, such as near the chest or groin area of the outer surface of his coat.

Means to removably attach the strap portion of the glove holder to the outer garment includes a metal clip sewn onto the strap (or garment) and a cooperating ring sewn onto the outer surface of the garment (or strap), which clip includes a member depressable to engage the ring. Other means to removably attach the strap to the outer surface of the garment include one or a series of pull-the-dot fasteners and VELCRO®.

DETAILED DESCRIPTION OF THE PREFERRED EMBODIMENT

Figure 1A:
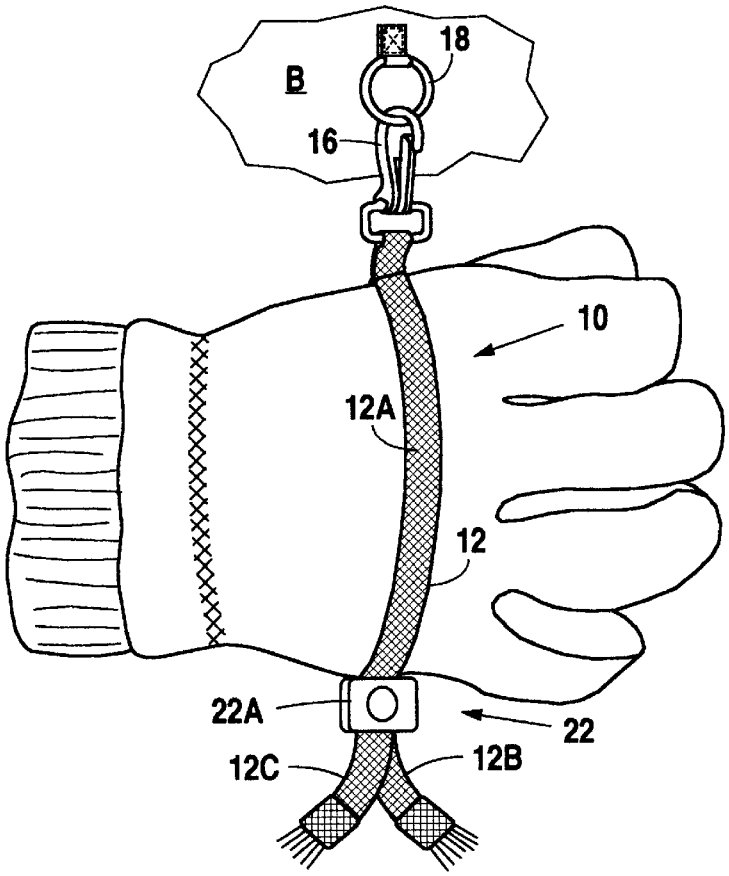
FIGS. 1A and 1B are front and rear views of Applicant's glove holder in use.
Figure 1B:
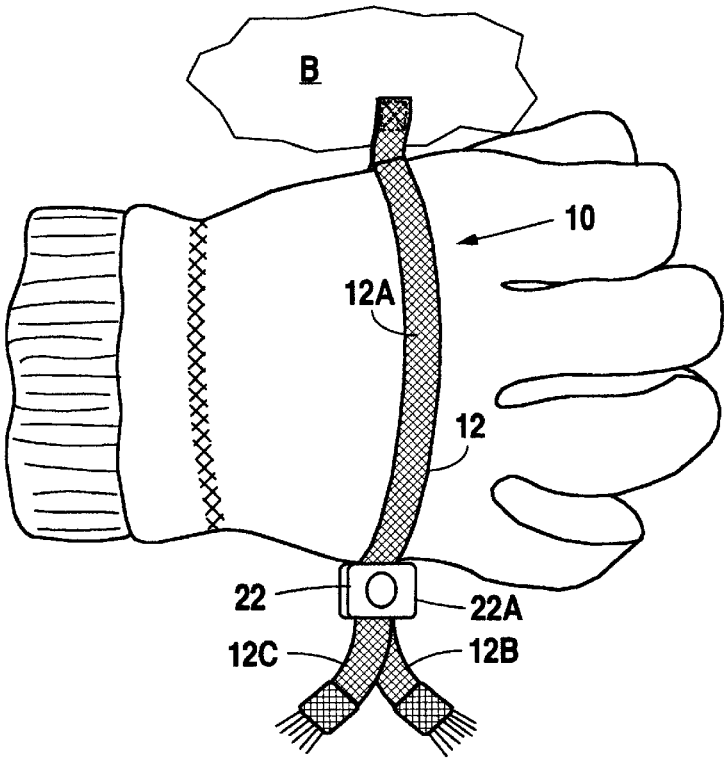
Figure 3:
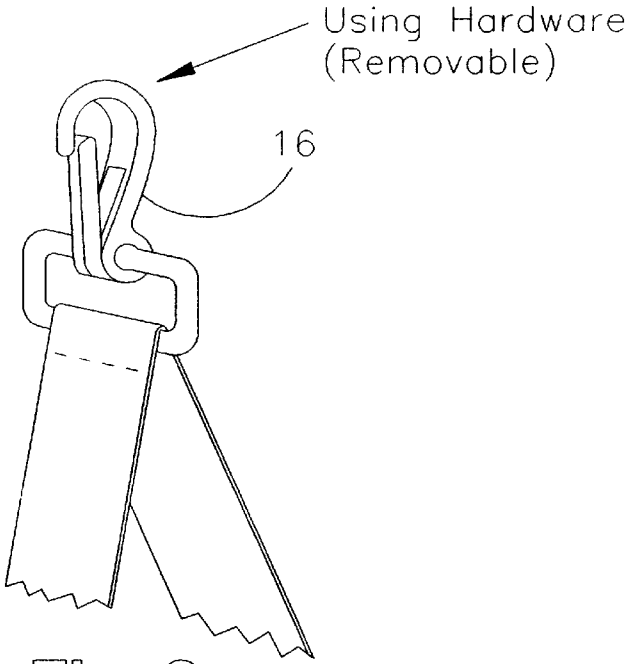
FIG. 3 is a perspective side view of removable means of Applicant's present invention illustrating one means of removing the strap from the outer garment of the firefighter's protective uniform.

FIGS. 1A and 1B illustrate two alternate preferred embodiments of Applicant's glove holder 10. As can be seen in the figures, glove holder 10 is designed to hold gloves A to the outer surface of a garment B. The garment may be part of the firefighter's uniform, such as the coat or pants. Glove holder 10 is seen to include strap 12 having a body 12A, a first removed end 12B, and a second removed end 12C. In some alternate preferred embodiments (see FIGS. 1A, 3, 3A, 3B, 3C, 4A, 4B, 4C, 6A, and 6B), the body has attached thereto means 14, such as a metal or plastic clip 16 to cooperate with a ring 18 sewn onto the garment for removably fastening the strap to the garment. On the other hand, strap 12 may include means for permanently attaching the strap to the outer garment, including thread 20 here seen to attach a portion of body 12 of the strap directly to the material of the outer surface of protective garment B. The thread may be made of NOMEX®, KEVLAR® or PBI®, all approved by the NFPA for their fire-resistant qualities.

Figure 2B:
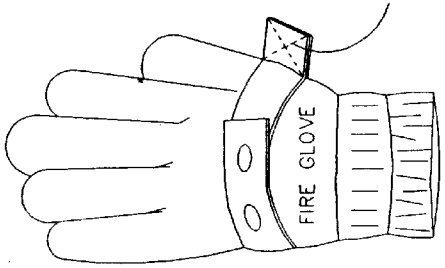
FIG. 2B is a perspective side view of the alternate preferred embodiment of FIG. 2A in use.
Figure 2A:
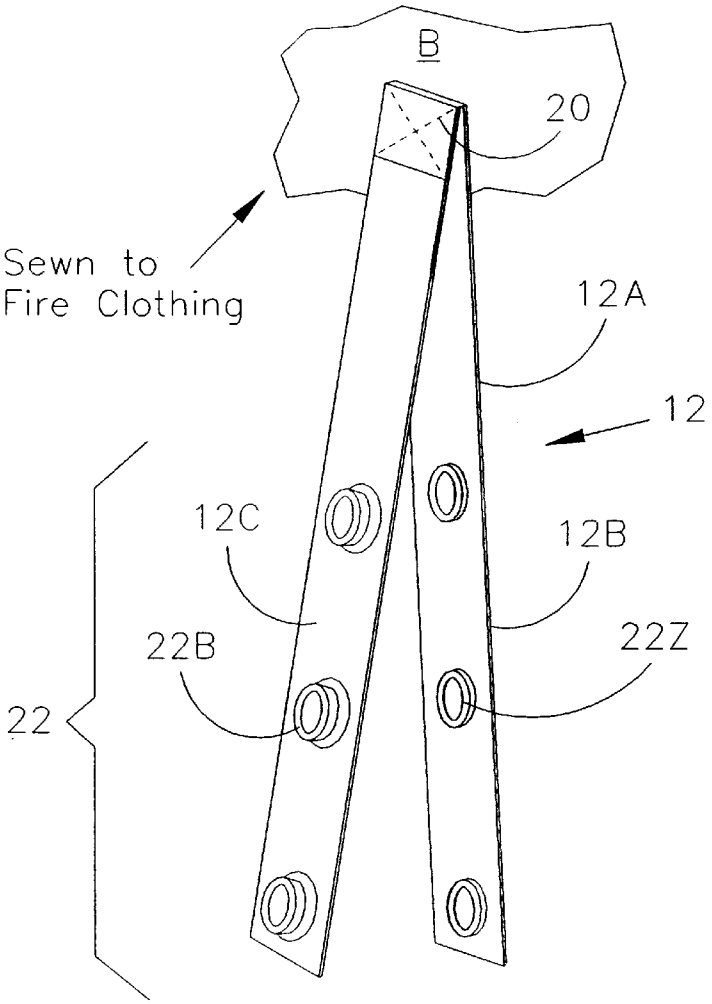
FIG. 2A is a perspective side view of an alternate preferred embodiment of Applicant's present invention.
Figure 3A:
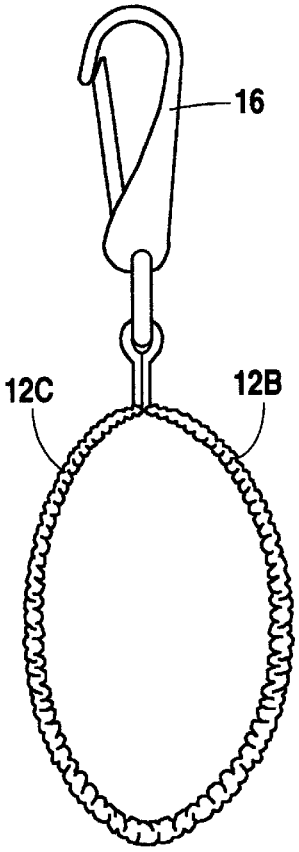
FIG. 3A is a side elevational view of an alternate preferred embodiment of Applicant's present invention wherein the strap is made of an elastic material and means to removably attach the strap to the outer garment is a metal clip.
Figure 3B:
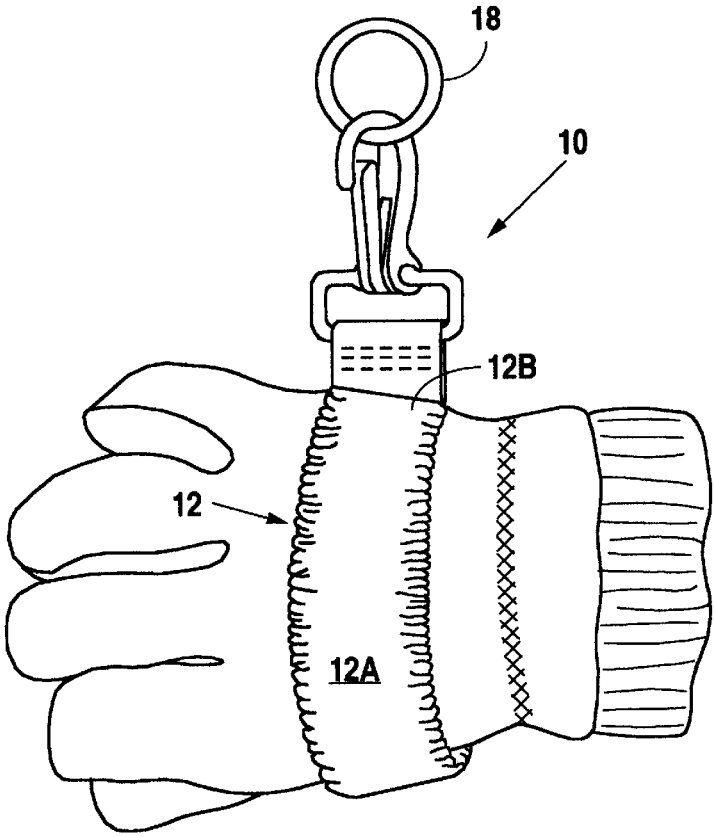
FIG. 3B is a side perspective view of the alternate preferred embodiment as set forth in FIG. 3A of Applicant's present invention in use.
Figure 3D:
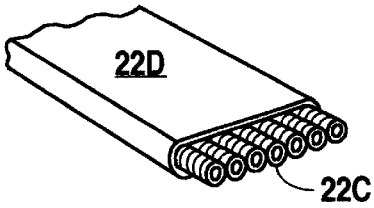
FIG. 3D is a side perspective cut-away of the strap of the preferred embodiment of Applicant's present invention as set forth in FIGS. 3A, 3B, and 3C.
Figure 3C:
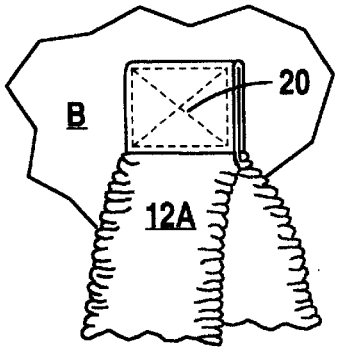
FIG. 3C is a side perspective view of a portion of Applicant's present invention illustrating means to permanently fasten the strap to the outer garment of the firefighter's uniform.
Figure 3E:
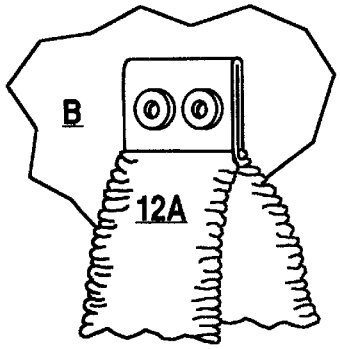
FIG. 3E is a front elevational view of a pop rivet, used in fastening the glove holder to the outside of a garment.

The strap 12 of Applicant's invention is provided with, at or near the removed ends thereof, means 22 for joining the ends and for adjusting the size of the enclosure in which the gloves are placed. Means 22 in FIGS. 1A and 1B include a drawstring clasp 22A. FIG. 2A and 2B disclose the use of pull-the-dot fasteners as means 22 for removably fastening the two ends together. Further, it is seen with a multiplicity of sets (here three sets) of pull-the-dot fasteners the size of the closure can be adjusted. For example, attaching the first female portion 22Z to the second male portion 22B to form a smaller enclosure.

FIGS. 3A, 3B, 3C, and 3D illustrate means for enclosure adjustment 22, said means utilizing bungee cord strap or elastic cord 22C covered by a protective material, such as NOMEX®, KEVLAR®, or other materials 22D. In the embodiment illustrated in these figures, a means for enclosure adjustment is the material itself, which may take on a stretched or biased condition, such as when an outside force is applied or a relaxed condition, such as when gloves are inserted therein and restricted within the material 22C, which condition is normal condition with an outside force removed. In other words, the material can be stretched, the gloves inserted, the force released, and the material will relax to constrict and enclose the gloves within its confines.

Figure 4A:
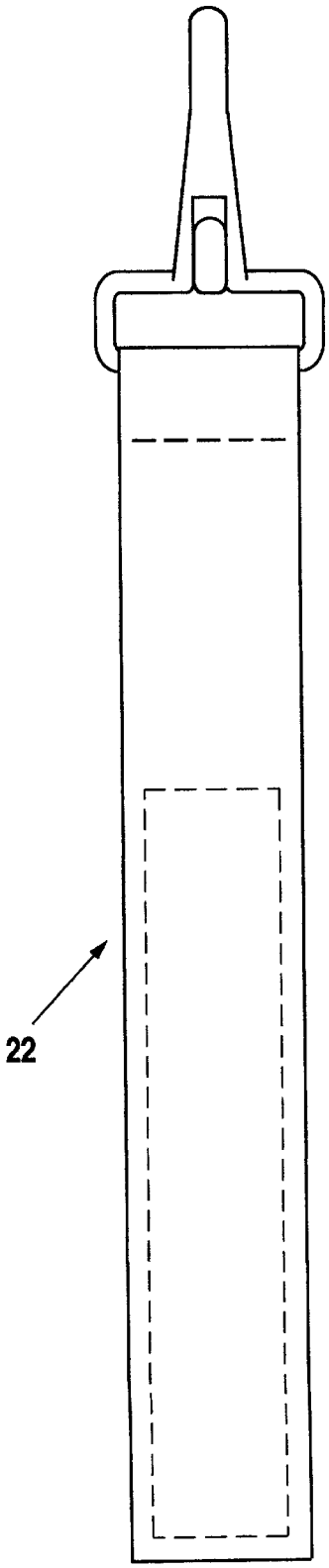
FIGS. 4A, 4B, and 4C are front, back and side elevational views of the strap of Applicant's present invention with a clip attached thereto for removably attaching the strap to an outer garment of the firefighter's protective uniform.
Figure 4B:
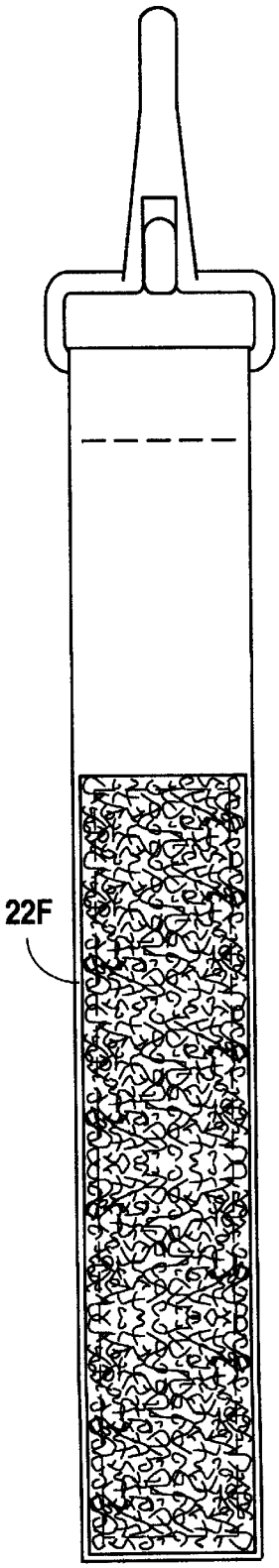
Figure 4C:
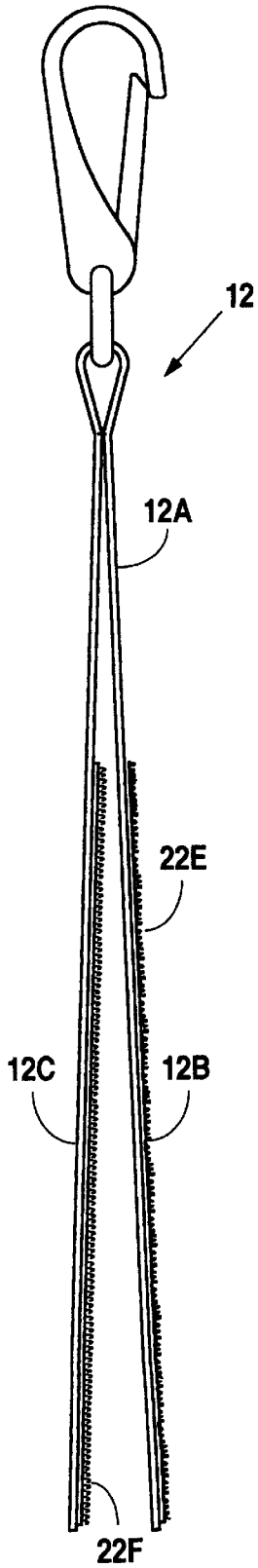
Figure 5A:
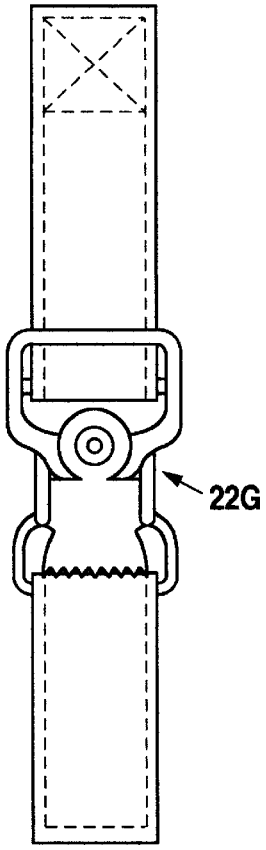
FIG. 5A is a front elevational view of Applicant's present invention illustrating the strap sewn permanently to the firefighters uniform and a tourniquet buckle for attaching the removed ends of the strap and adjusting the size of the enclosure in which the gloves are placed.
Figure 5B:
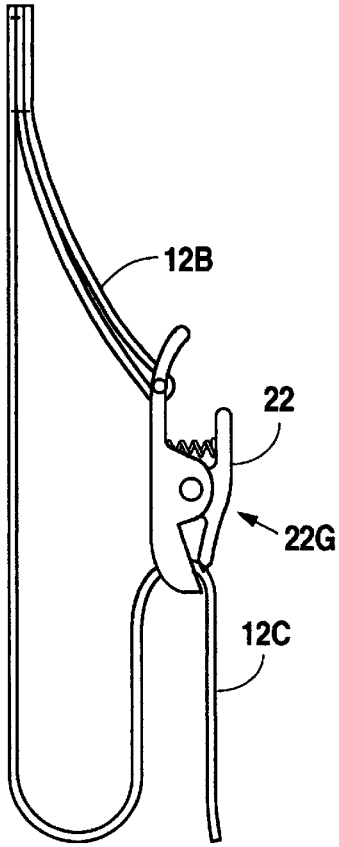
FIG. 5B is a side elevational view of the embodiment set forth in FIG. 5A.

FIGS. 4A, 4B, and 4C illustrate yet another alternate preferred embodiment of means 22 for enclosure adjustment, which means 22 are attached to removed ends 12B and 12C of the strap 12. In the illustration set forth in FIGS. 4A, 4B, and 4C, removed ends include VELCRO® hook and pile pods, here hook 22E and pile 22F forming pads for attached to removed ends of the strap, which can readily be adjusted one to the other in length so as to form an enclosure tightly around the gloves of the glove holder 10.

Figure 5C:
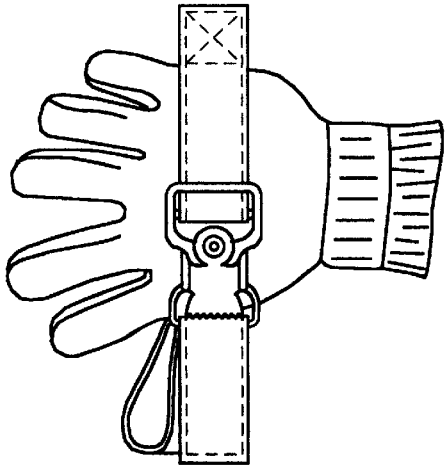
FIGS. 5C and 5D are perspective side views of the alternate preferred embodiment of Applicant's present invention featured in FIGS. 5A and 5B where the strap is in a loose position (FIG. 5C) and is in a "cinched" position (FIG. 5D).
Figure 5D:
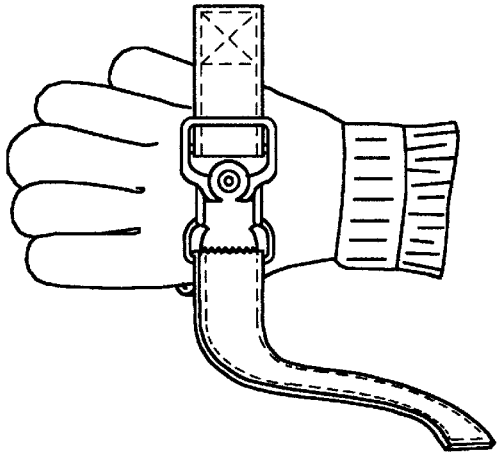

Yet another alternate preferred embodiment of means 22 for enclosure adjustment is found in FIGS. 5A, 5B, 5C, and 5D. In this embodiment it can be seen that means 22 for attachment and adjustment includes a biased jaw clasp 22G (such as that available from Scott Breathing Equipment), which is attached to first end 12B. Second end 12C is directed through the jaws of the clasp. FIGS. 5C and 5D illustrate how the gloves are placed in the enclosure of the strap in loose position and, second end 12C is pulled to reduce the size of the enclosure and trap the gloves within ("cinched" position).

Figure 6A:
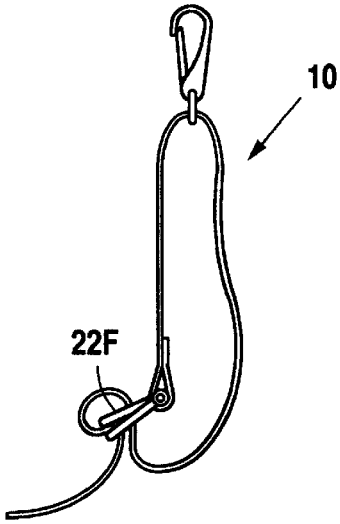
FIGS. 6A and 6B illustrate in side elevational view and cut-away detail the use of a pair of D-rings to adjustably attach the removed ends of the strap.
Figure 6B:
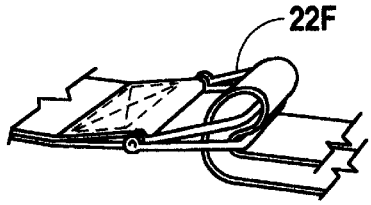

FIGS. 6A and 6B illustrate another preferred embodiment of means 22, here a double pair of D rings 22F attached to one end, for receipt of the send end of the strap through the two D-rings, to provide an adjustable enclosure.

The following products are available through National Webbing Products Co. of Garden City Park, N.Y. (nationalwebbing.com) for attaching the strap to the outer garment of a firefighter's uniform. Trigger Snap #098, Swivel Snap #017, Snaphook #026, Ratchet Buckle #509, Lanyard Hook #068, and other hooks made of metal or compression molded plastic. Other means to attach the strap to the outer garment of the firefighters uniform can be found in the Buyer's Guide (1996) available from The Leather Factory®, 435-E Henry Brennan Drive, El Paso, Tex. 79926, these including: Halter Snaps, Spring Snaps, Round Trigger Snaps, Saddle Snaps, Chap Snaps, D-rings, Square Dee rings, and Solid Dee rings.

The National Webbing Products catalog also provides means to adjustably attach the two removed ends of the strap of Applicant's present invention, including: CLB Ball Cord Lock, CLSQ Square Cord Lock, CLH Cord Lock (drawstring clasps), NSR Side Release Buckle, NCR Center Release Buckle, STLC Straplock, NSL Slide, DDR Double D-ring, NCB Cam Buckle, Halter Strap or Tack Buckles, Suspender Clips, or Floating Bar Buckles.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. In combination, an improved glove holder and a pair of gloves comprising:

a strap means for holding said gloves, said strap means including a single strap of material having a means for adjustably engaging and securing said strap about said pair of gloves perpendicular to a longitudinal axis of said pair of gloves and a fastening means for fastening said strap to an article of protective clothing whereby, when said strap means is secured to said pair of gloves, said strap means extends proximate a palm area of said pair of gloves and said pair of gloves are unsecured from said strap means before a wearer dons said pair of gloves.

2. The glove holder of claim 1 wherein the strap is made from fire proof material.

3. The device of claim 1 wherein the means for adjustably engaging and securing includes hook and pile fasteners at removed ends of the single strap.

4. The device of claim 1 wherein the means for adjustably engaging and securing includes a series of pull-the-dot snap fasteners on the removed ends of the strap.

5. The device of claim 1 wherein the means for adjustably engaging and securing includes a drawstring slider mechanism for threading removed ends of the strap therethrough.

6. The device of claim 1 wherein the body of the strap is elastic and covered with a fire-retardant material.

7. The device of claim 1 wherein said fastening means includes a clip attached to the body of the strap.

8. The device of claim 1 wherein the fastening means includes thread.

9. The device of claim 1 wherein the fastening means includes a pop rivet.

* * * * *